US008912970B1

(12) United States Patent
Manry, Jr. et al.

(10) Patent No.: US 8,912,970 B1
(45) Date of Patent: Dec. 16, 2014

(54) ANTENNA ELEMENT WITH INTEGRAL FARADAY CAGE

(75) Inventors: Charles W. Manry, Jr., Auburn, WA (US); Lixin Cai, Ravensdale, WA (US); Joel Daniel Barrera, College Station, TX (US)

(73) Assignee: The Boeing Company, Chicago, IL (US)

( * ) Notice: Subject to any disclaimer, the term of this patent is extended or adjusted under 35 U.S.C. 154(b) by 462 days.

(21) Appl. No.: 13/301,110

(22) Filed: Nov. 21, 2011

Related U.S. Application Data

(63) Continuation-in-part of application No. 13/052,034, filed on Mar. 18, 2011, now Pat. No. 8,773,323.

(51) Int. Cl.
*H01Q 1/52* (2006.01)

(52) U.S. Cl.
USPC ..... 343/841; 343/700 MS

(58) Field of Classification Search
USPC ..... 343/700 MS, 841
See application file for complete search history.

(56) References Cited

U.S. PATENT DOCUMENTS

| | | | | |
|---|---|---|---|---|
| 7,215,288 | B2 * | 5/2007 | Park et al. | 343/702 |
| 7,427,957 | B2 * | 9/2008 | Zeinolabedin Rafi et al. | 343/700 MS |
| 8,279,131 | B2 * | 10/2012 | Puzella et al. | 343/853 |
| 2007/0171071 | A1 * | 7/2007 | Chiu et al. | 340/572.7 |

OTHER PUBLICATIONS

Jin-Sen Chen, "Dual-Frequency Annular-Ring Slot Antennas Fed by CPW Feed and Microstrip Line Feed," IEEE Transactions APS, vol. 53, No. 1, Jan. 2005, pp. 569-571.

Yu-Jiun Ren, "An Ultrawideband Microstrip Dual-Ring Antenna for Millimeter-Wave Applications," IEEE Antennas & Wireless Propagation Letters, vol. 6, 2007, pp. 457-459.

A Das, B. Sc., M.sc, et al, "Radiation Characteristics of Higher-Order Modes in Microstrip Ring Antenna," IEE Proceedings, vol. 131, Pt H, No. 2, Apr. 1984, pp. 102-103.

Weng Cho Chew, "A Broad-Band Annular-Ring Microstrip Antenna", IEEE Transactions APS, vol. AP-30, No. 5, Sep. 1982, Section I pp. 918-919, Section V pp. 920-921.

I.J. Bahl, et al, "A New Microstrip Radiator for Medical Applications," IEEE Transactions on Microwave Theory and Techniques, vol. MTT-28, No. 12, Dec. 1980, pp. 1464-1468.

* cited by examiner

*Primary Examiner* — Dieu H Duong

(74) *Attorney, Agent, or Firm* — Ameh IP; Lowell Campbell; Elahe Toosi

(57) ABSTRACT

An antenna structure and method are disclosed. A faraday cage is operable to shield a conductive resonator, the faraday cage comprising an electromagnetically-shielding ground plane. A shorting pin is coupled to the conductive resonator and the electromagnetically-shielding ground plane, and is operable to electrically couple the conductive resonator to the electromagnetically-shielding ground plane.

20 Claims, 7 Drawing Sheets

ANTENNA ELEMENT WITH INTEGRAL FARADAY CAGE

CROSS-REFERENCE TO RELATED APPLICATION

This application claims priority under U.S.C. 120 to and is a Continuation-in-part application of U.S. patent application Ser. No. 13/052,034 filed 18 Mar. 2011 now U.S. Pat. No. 8,773,323, content of which is incorporated herein by reference in its entirety.

FIELD

Embodiments of the present disclosure relate generally to antennas. More particularly, embodiments of the present disclosure relate to microwave and millimeter-wave frequency antennas.

BACKGROUND

Current microwave and millimeter-wave frequency antennas generally comprise cumbersome structures such as waveguides, dish antennas, helical coils, horns, and other large non-conformal structures. Communication applications where at least one communicator is moving and radar applications generally require a steerable beam and/or steerable reception. Phased array antennas are particularly useful for beam steered applications since beam steering can be accomplished electronically without physical motion of the antenna. Such electronic beam steering can be faster and more accurate and reliable than gimbaled/motor-driven mechanical antenna steering.

SUMMARY

An antenna structure and method are disclosed. A faraday cage is operable to shield a conductive resonator, the faraday cage comprising an electromagnetically-shielding ground plane. A shorting pin is coupled to the conductive resonator and the electromagnetically-shielding ground plane, and is operable to electrically couple the conductive resonator to the electromagnetically-shielding ground plane.

In this manner, the antenna structure provides a wide scan volume (e.g., better than 60 degrees of conical scan volume from boresight) and maintains good circular polarization axial ratio over specified frequency bands.

The antenna structure minimizes size, weight, and power (SWAP), as well as minimizing integration cost. SWAP is greatly reduced by elimination of "stovepiped" Satellite Communication (SATCOM) narrow banded systems and associated separate antenna installations. The antenna structure provides a phased array antenna that can cover at least one SATCOM transmit and/or receive military Extremely High Frequency (EHF) band, while being thin and lightweight. Furthermore, the antenna structure may be scaled to other frequency bands and phased array applications such as, for example but without limitation, Line-of-Sight communication links, Signals Intelligence (SIGINT) arrays, radars, sensor arrays, or other frequency band or phased array application. In addition, the antenna structure provides a conformal antenna operable to greatly reduce fluid dynamic drag and integration/maintenance cost.

In an embodiment, an antenna structure comprises a conductive resonator, a faraday cage, and a shorting pin. The faraday cage is operable to shield the conductive resonator, and the faraday cage comprises an electromagnetically-shielding ground plane. The shorting pin is coupled to the conductive resonator and the electromagnetically-shielding ground plane, and is operable to electrically couple the conductive resonator to the electromagnetically-shielding ground plane.

In another embodiment, a method for forming an antenna structure provides a conductive resonator, and provides a faraday cage operable to shield the conductive resonator, the faraday cage comprising an electromagnetically-shielding ground plane. The method further provides a shorting pin coupled to the conductive resonator and the electromagnetically-shielding ground plane, and operable to electrically couple the conductive resonator to the electromagnetically-shielding ground plane.

In a further embodiment, a method for communication using an antenna structure resonates a conductive resonator electromagnetically coupled to a feed line. The method further electromagnetically-shields the conductive resonator and the feed line via a faraday cage comprising an electromagnetically-shielding ground plane. The method further electrically couples the conductive resonator to the electromagnetically-shielding ground plane via a shorting pin coupled to the conductive resonator and the electromagnetically-shielding ground plane.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF DRAWINGS

A more complete understanding of embodiments of the present disclosure may be derived by referring to the detailed description and claims when considered in conjunction with the following figures, wherein like reference numbers refer to similar elements throughout the figures. The figures are provided to facilitate understanding of the disclosure without limiting the breadth, scope, scale, or applicability of the disclosure. The drawings are not necessarily made to scale.

DETAILED DESCRIPTION

Figure 1:
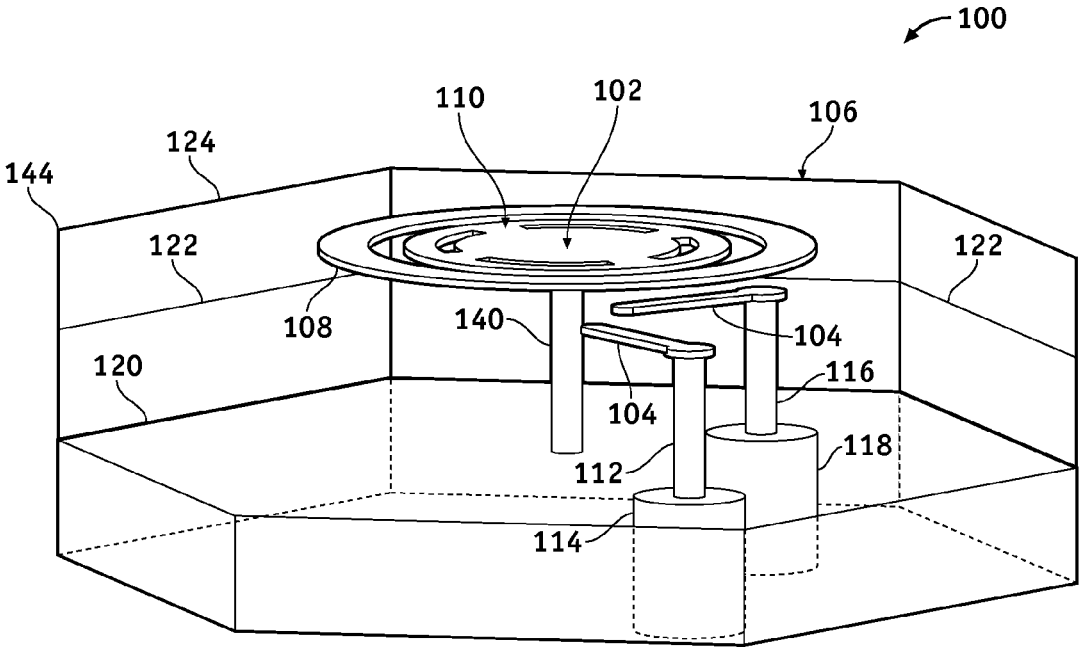
FIG. 1 is an illustration of an exemplary antenna structure according to an embodiment of the disclosure.

The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. The present disclosure should be accorded scope consistent with the claims, and not limited to the examples described and shown herein.

Embodiments of the disclosure may be described herein in terms of functional and/or logical block components and various processing steps. It should be appreciated that such block components may be realized by any number of hardware, software, and/or firmware components configured to perform the specified functions. For the sake of brevity, conventional techniques and components related to antenna design, antenna manufacturing, and other functional aspects of the systems (and the individual operating components of the systems) may not be described in detail herein. In addition, those skilled in the art will appreciate that embodiments of the present disclosure may be practiced in conjunction with a variety of hardware and software, and that the embodiments described herein are merely example embodiments of the disclosure.

Embodiments of the disclosure are described herein in the context of a practical non-limiting application, namely, a planar or conformal satellite communication phased array antenna. Embodiments of the disclosure, however, are not limited to such planar satellite communication applications, and the techniques described herein may also be utilized in other applications. For example but without limitation, embodiments may be applicable to conformal antennas, manned and unmanned aircraft antennas, sensor antennas, radar antennas, and other antennas.

As would be apparent to one of ordinary skill in the art after reading this description, the following are examples and embodiments of the disclosure and are not limited to operating in accordance with these examples. Other embodiments may be utilized and structural changes may be made without departing from the scope of the exemplary embodiments of the present disclosure.

Current microwave scanning antennas use multiple phased array antenna apertures for each band and/or dual band dish antennas under radomes. On-aircraft dishes generally must be placed under aerodynamic radomes adding significantly to weight of an aircraft, aerodynamic drag and maintenance complication.

Embodiments of the disclosure provide a conformal phased array antenna element for a single/multi-band transmit and/or receive aperture for bi-directional satellite communication and other communications, for example but without limitation, about 27.5-30 GHz for commercial bands, about 30-31 GHz and about 43.5-45.5 GHz for military bands, signals in adjacent Ka-bands, and other frequency bands. Embodiments of the disclosure provide for a light weight and very thin single transmit and/or receive conformal phased array antenna element, with wide scan volume to about 60 degrees or greater angle from boresight.

FIG. 1 is an illustration of an exemplary antenna structure 100 (antenna structure 100) according to an embodiment of the disclosure. The antenna structure 100 comprises a conductive resonator 102, feed lines 104, a faraday cage 106 comprising an electromagnetically-shielding ground plane 120, and a shorting pin 140.

The conductive resonator 102 uses the shorting pin 140 coupled from a top center of the conductive resonator 102 to the electromagnetically-shielding ground plane 120. A spoked conductive resonator 110 comprises an inner disk 204 (FIG. 2) across a center of the conductive resonator 102 that provides connectivity to the spoked conductive resonator 110. This allows for the antenna structure 100 to extend the frequency coverage to comprise the commercials band of about 27.5-30 GHz, while retaining performance in the military bands of about 30-31 GHz.

The conductive resonator 102 is operable to resonate at electromagnetic frequencies to be transmitted or received. The conductive resonator 102 may comprise, for example but without limitation, a single resonator, a plurality of resonators, slotted resonators, resonators on multiple layers, or other resonator. In the embodiment shown in FIG. 1, the conductive resonator 102 may comprise at least one ring structure such as a ring conductive resonator 108 and at least one spoked structure such as a spoked conductive resonator 110. The ring conductive resonator 108 and the spoked conductive resonator 110 may comprise, for example but without limitation, metallization, a microstrip, direct-write, or other suitable resonator.

Figure 2:
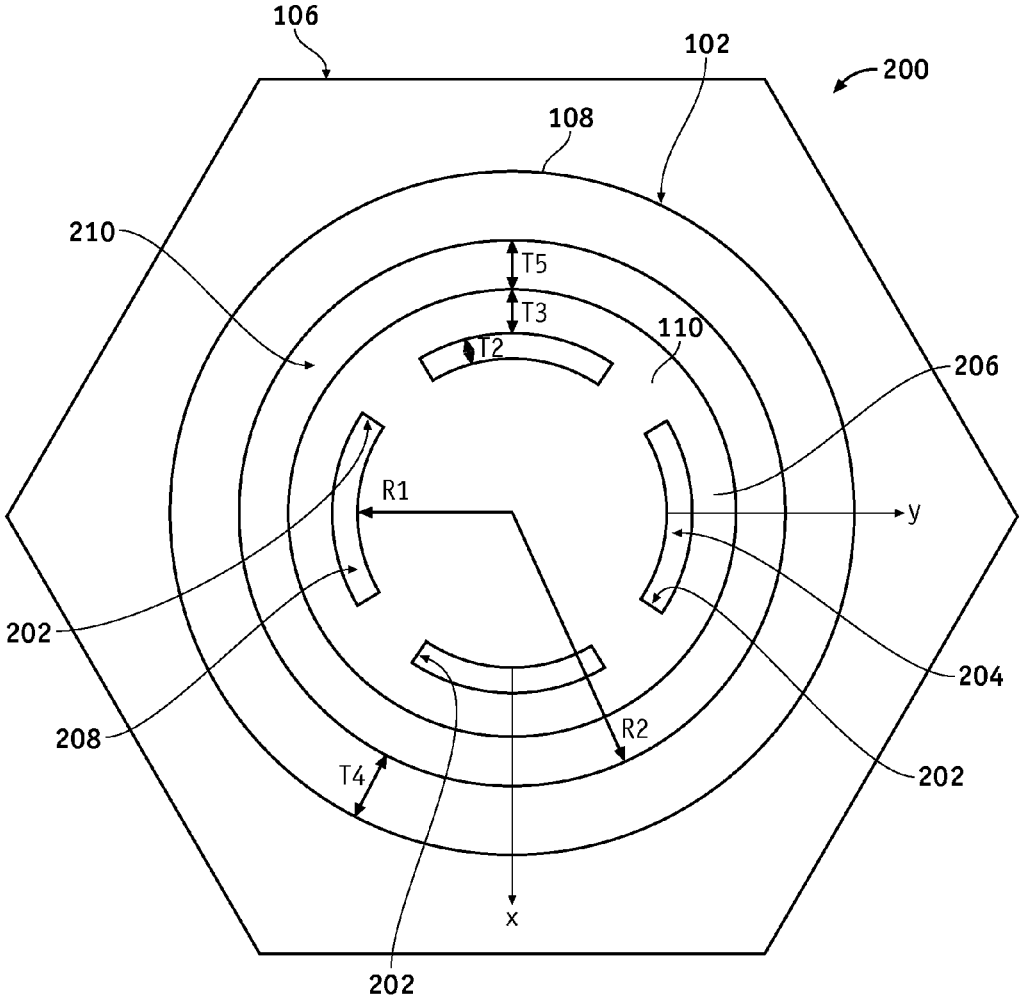
FIG. 2 is an illustration of an exemplary expanded partial top view of the antenna structure of FIG. 1 showing a conductive resonator in more detail according to an embodiment of the disclosure.

As discussed below in more detail in the context of discussion of FIG. 2, the conductive resonator 102 comprises the ring conductive resonator 108 (ring shaped microstrip), and the spoked conductive resonator 110 comprises an inner disk 204 and an outer linked ring 206 (FIG. 2) coupled by one or more spoke 202 (FIG. 2) and separated by one or more tuning slot 208 (FIG. 2). Use of the ring conductive resonator 108 as an outer ring, the spoked conductive resonator 110, and a slot resonator 210 (FIG. 2) between the ring conductive resonator 108 and the spoked conductive resonator 110, enables the antenna structure 100 to achieve a dual band operation according to an embodiment of the disclosure. However, in other embodiments, various shapes and combinations of resonators may be used to form a single-band antenna operable in a single frequency band, or a multi-band antenna capable of operation in two or more frequency bands.

For example but without limitation, the ring conductive resonator 108 is operable in an about 27.5-31 GHz frequency band, and the slot resonator 210 between the ring conductive resonator 108 and the spoked conductive resonator 110 is operable to provide a tuning structure for an about 43.5-45.5 GHz frequency band. The spoked conductive resonator 110 may comprise a smaller linked double ring structure comprising spokes 202, the inner disk 204, and the outer linked ring 206 operable to provide a tuning structure for the tuning slot 208 between the inner disk 204 and the outer linked ring 206.

Each of the feed lines 104 (feed line 104) is electromagnetically coupled to the conductive resonator 102 and is configured to drive the conductive resonator 102 and/or receive a signal from the conductive resonator 102. The feed lines 104 may comprise, for example but without limitation, a single feed line, a plurality of feed lines, or any suitable configuration of feed lines. In the embodiment shown in FIG. 1, the feed lines 104 comprise a first feed line 112 coupled to a first signal line 114, and a second feed line 116 coupled to a second signal line 118. The first feed line 112 and the second feed line 116 may comprise, for example but without limitation, metallization, a microstrip, or other feed line. The feed lines 104 comprise microstrip feed lines electromagnetically coupled to the conductive resonator 102.

The electromagnetic coupling comprises, for example but without limitation, an inductive coupling, a capacitive coupling, or other electromagnetic coupling. The feed lines 104 may be located on a middle layer below the conductive resonator 102. For example but without limitation, the feed lines 104 may be located about 20 mils below the conductive resonator 102, or other suitable location. The feed lines 104 may be coupled to external electronics (not shown) using coupling vias (e.g., vias other than conductive vias 410 in FIG. 4) through an electromagnetically-shielding ground plane 120 to the feed lines 104. The feed lines 104 may be spaced, for example but without limitation, about 90 degrees apart to allow for selectable right-hand circular polarized or left-hand circular polarized Satellite Communications (SATCOM) signals, or other suitable spacing.

Figure 4:
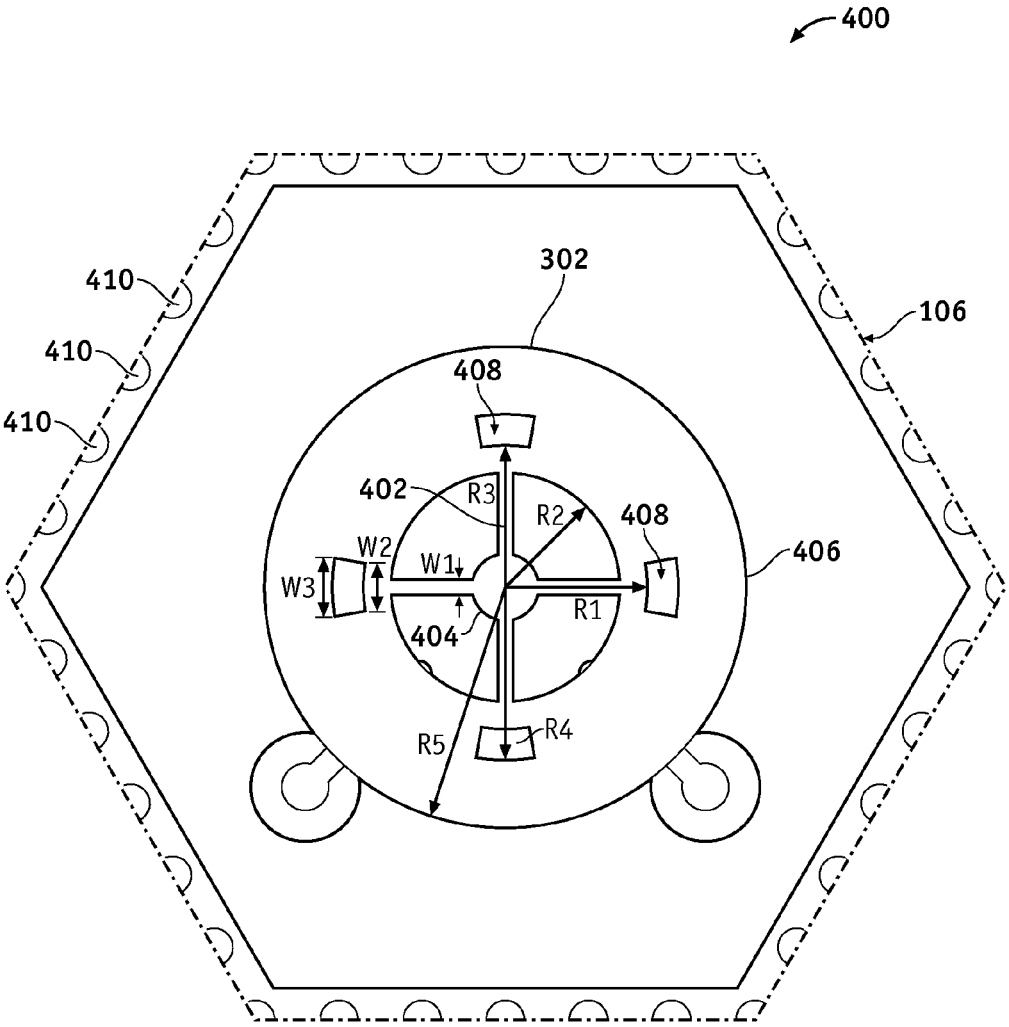
FIG. 4 is an illustration of an exemplary expanded partial top view of the antenna structure of FIG. 3 showing a conductive resonator in more detail according to an embodiment of the disclosure.

The faraday cage 106 is configured to shield the conductive resonator 102 and the feed lines 104. In this manner, the faraday cage 106 may comprise, for example but without limitation, the electromagnetically-shielding ground plane 120, a first conductive strip 122, a second conductive strip 124, and a plurality of conductive vias 410 (FIG. 4). The conductive vias 410 are coupled to the electromagnetically-shielding ground plane 120, the first conductive strip 122, and the second conductive strip 124 to form an electrically conductive cage operable to isolate/shield the conductive resonator 102 and the feed lines 104 from bottom and side external electrical fields such as a neighboring antenna. The neighboring antenna may comprise, for example but without limitation, the antenna structure 100 as an element of a lattice 702 (FIG. 7), external antennas of neighboring devices, or other antenna. The faraday cage 106 may comprise, for example but without limitation, metallization, a microstrip, a circuit board material, direct write, or other suitable material.

Figure 7:
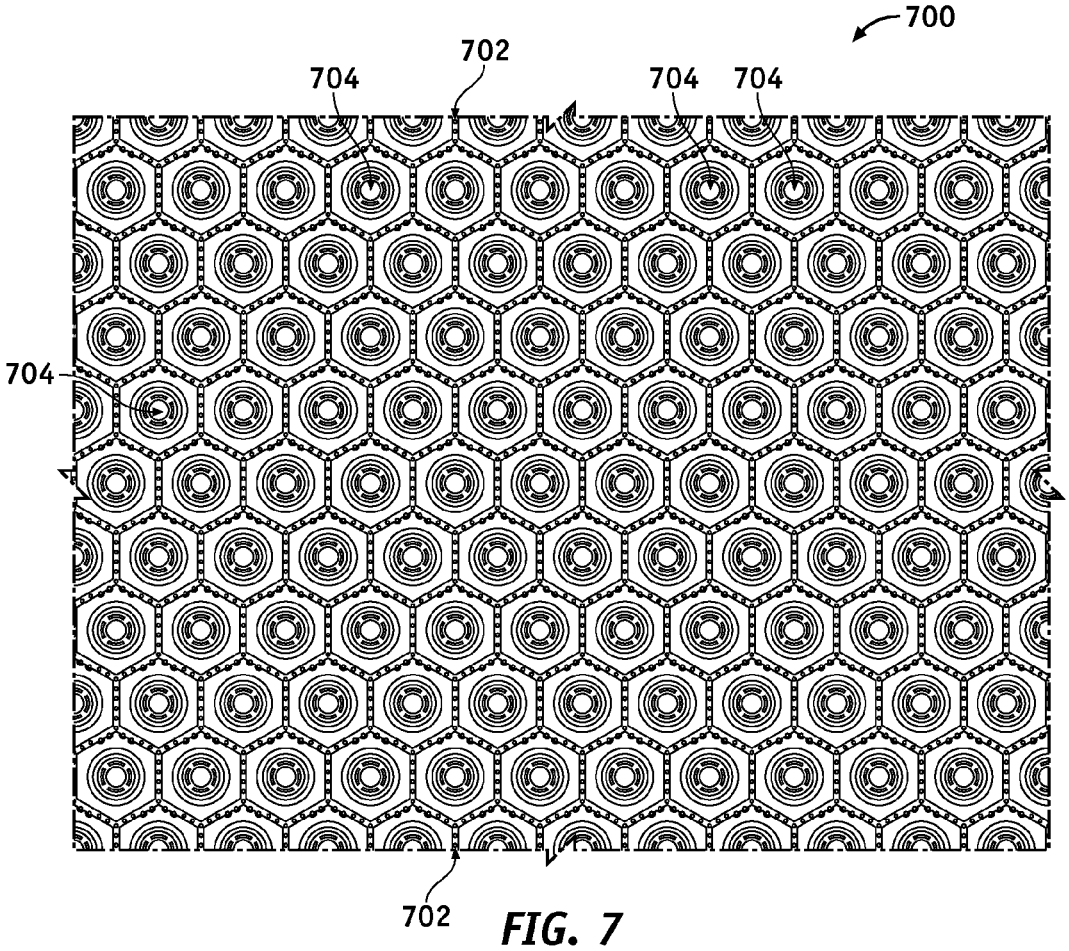
FIG. 7 is an illustration of an exemplary fabricated phased array antenna according to an embodiment of the disclosure.

The faraday cage 106 may comprise a periodic unit cell such as a unit cell 704 (antenna structure 704) in FIG. 7, with its outer boundary outline printed on layers of a circuit board with the conductive vias 410 extending from the top layer 144 of the antenna structure 100 to the electromagnetically-shielding ground plane 120. The conductive vias 410 are spaced along the first conductive strip 122 and the second conductive strip 124 of the antenna structure 100. The faraday cage 106 may be made using any appropriate lattice spacing and shape to form a phased array antenna 700 (FIG. 7). The faraday cage 106 may comprise, for example but without limitation, a hexagonal lattice, a triangular lattice, a square lattice, or other shape. In this manner, the antenna structure 100 forms the phased array antenna 700 where conductive strips 122/124 form the lattice 702 (FIG. 7).

The shorting pin 140 is electrically coupled to the conductive resonator 102 and the electromagnetically-shielding ground plane 120. The shorting pin 140 is operable to electrically couple the conductive resonator 102 to the electromagnetically-shielding ground plane 120.

FIG. 2 is an illustration of an exemplary expanded top view of the antenna structure 100 of FIG. 1 (antenna structure 200) showing the conductive resonator 102 in more detail according to an embodiment of the disclosure. The conductive resonator 102 may comprise, for example but without limitation, the ring conductive resonator 108, the spoked conductive resonator 110, the slot resonator 210 between the ring conductive resonator 108 and the spoked conductive resonator 110, or other resonator.

The ring conductive resonator 108 may comprise a ring resonator width T4 and a ring resonator inner diameter R2. The slot resonator 210 may comprise a slot resonator width T5. The spoked conductive resonator 110 may comprise an inner disk 204 comprising a diameter R1, an outer linked ring 206 comprising an outer linked ring width T3, a tuning slot 208 comprising a tuning slot width T2 and one or more spoke 202 coupling the inner disk 204 and the outer linked ring 206.

In the embodiment shown in FIG. 2, the spoked resonator inner diameter R1 is about 17 mils, the ring resonator inner diameter R2 is about 40 mils, the tuning slot width T2 is about 4 mils, the outer linked ring width T3 is about 6 mils, the ring resonator width T4 is about 10 mils, and the slot resonator width T5 is about 8 mils. Other dimensions can also be used for R1, R2, T2, T3, T4, and T5 to provide suitable operation of the conductive resonator 102.

The slot resonator 210, the ring conductive resonator 108, and the spoked conductive resonator 110 may comprise a tunable structure operable to tune a frequency of the slot resonator 210. As mentioned above, the conductive resonator 102 may comprise a set of linked rings such as the spoked conductive resonator 110 comprising the inner disk 204 and the outer linked ring 206 creating a tuning structure for the tuning slot 208 between the inner disk 204 and the outer linked ring 206. R1, R2, T2, T3, T4, and T5 may be chosen, for example but without limitation, to suitably tune the slot radiator 210, the slot resonator 210, the ring conductive resonator 108, and the spoked conductive resonator 110, or for other design purpose.

The conductive resonator 102 may comprise any material suitable for operation of the conductive resonator 102 such as, for example but without limitation, copper, polysilicon, silicon, aluminum, silver, gold, steel, meta-materials, or other material.

Figure 3:
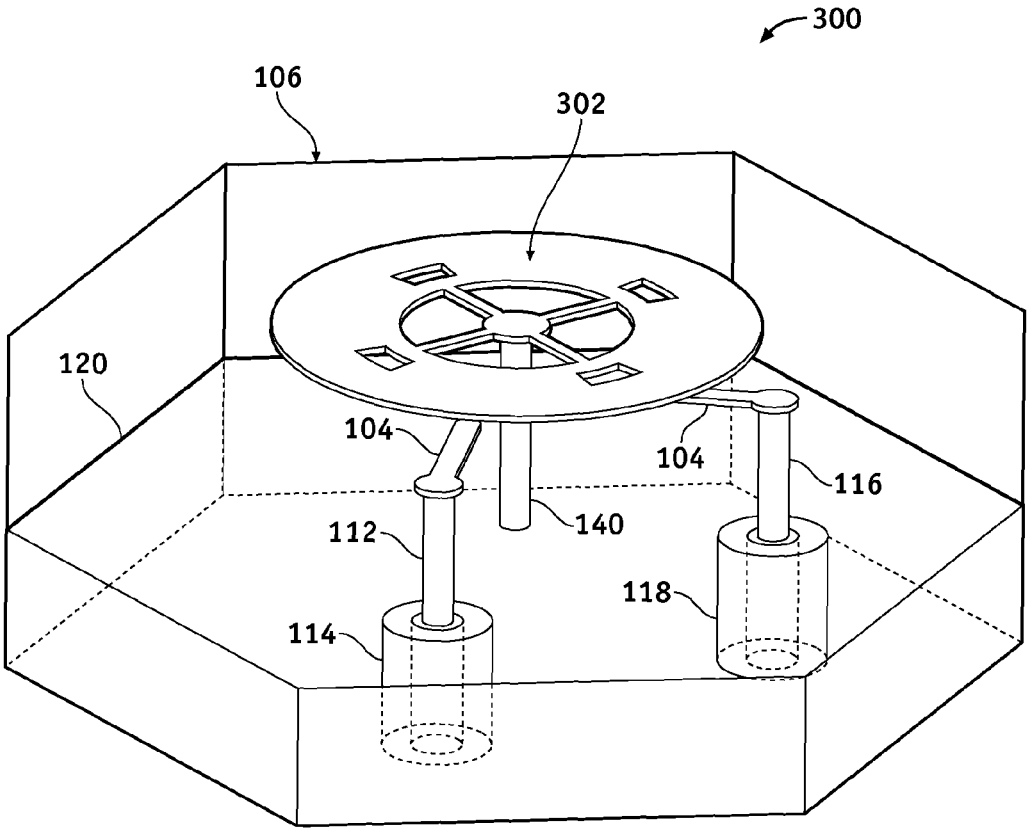
FIG. 3 is an illustration of an exemplary antenna structure according to an embodiment of the disclosure.

FIG. 3 is an illustration of an exemplary antenna structure (antenna structure 300) according to an embodiment of the disclosure. The antenna structure 300 comprises a conductive resonator 302, the feed lines 104, the faraday cage 106 comprising the electromagnetically-shielding ground plane 120, and the shorting pin 140. The antenna structure 300 may have functions, material, and structures that are similar to the embodiments shown in FIGS. 1-2. Therefore common features, functions, and elements may not be redundantly described here. The conductive resonator 302 is described in the context of discussion of FIG. 4.

FIG. 4 is an illustration of an exemplary expanded partial top view of the antenna structure 300 of FIG. 3 (antenna structure 400) showing the conductive resonator 302 in more detail according to an embodiment of the disclosure. The conductive resonator 302 comprises an inner disk 404 (tuning structure) electrically coupled to the shorting pin 140 (FIG. 3) to provide connectivity to the electromagnetically-shielding ground plane 120 (FIG. 1). The conductive resonator 302 is operable to resonate at electromagnetic frequencies to be received or transmitted.

The conductive resonator 302 may comprise, for example but without limitation, a single resonator, a plurality of resonators, slotted resonators, resonators on multiple layers, or other resonator. The conductive resonator 302 may comprise, for example but without limitation, metallization, a microstrip, direct-write, or other conductor. In the embodiment shown in FIG. 4, the conductive resonator 302 comprises a spoked conductive resonator comprising an inner disk 404 and an outer linked ring 406 coupled by one or more spoke 402 and separated by one or more tuning slot 408. In an alternate embodiment, the one or more tuning slot 408, the outer linked ring 406, and/or the one or more spoke 402 may be omitted. The one or more spoke 402 of the conductive resonator 302 are significantly enlarged to tune the antenna structure 300. This allows for the antenna structure 300 to have good circular polarization axial ratio over specified frequency bands and scan angular range in a phased array environment.

An antenna structure operable to achieve a dual band operation is provided according to an embodiment of the disclosure. However, in other embodiments, various shapes and combinations of resonators may be used to form a single-band antenna operable in a single frequency band, or a multi-band antenna capable of operation in two or more frequency bands. For example but without limitation, the conductive resonator 302 is operable in adjacent commercial and military frequency bands covering about 17.7-21.2 GHz. R1, R2, R3, R4, R5, W1, W2, and W3 may be chosen to suitably tune the conductive resonator 302. The conductive resonator 302 may comprise any material suitable for operation of the conductive resonator 302 such as, for example but without limitation, copper, polysilicon, silicon, aluminum, silver, gold, steel, meta-materials, or other suitable material.

Figure 5:
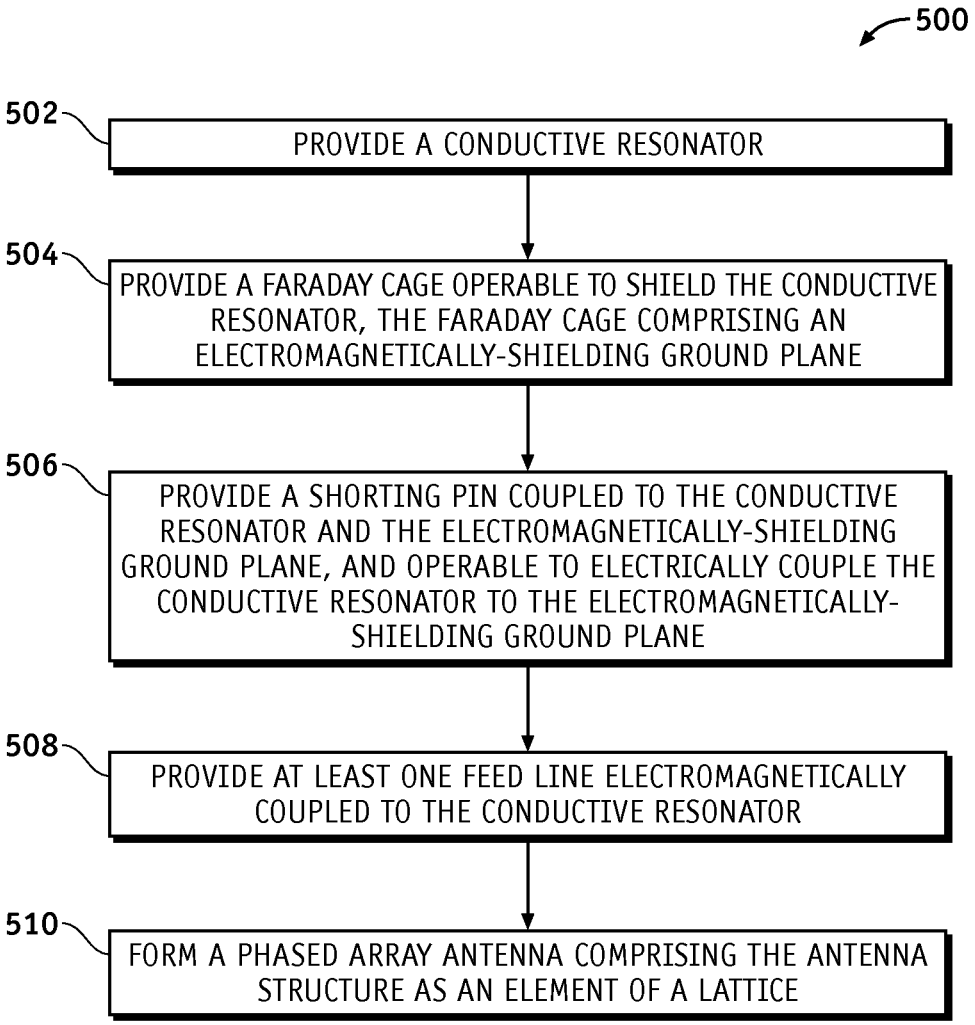
FIG. 5 is an illustration of an exemplary flowchart showing a manufacturing process for forming an antenna structure according to an embodiment of the disclosure.

FIG. 5 is an illustration of an exemplary flowchart showing an antenna structure manufacturing process 500 according to an embodiment of the disclosure. The various tasks performed in connection with process 500 may be performed mechanically, by software, hardware, firmware, or any combination thereof. It should be appreciated that process 500 may include any number of additional or alternative tasks, the tasks shown in FIG. 5 need not be performed in the illustrated order, and the process 500 may be incorporated into a more comprehensive procedure or process having additional functionality not described in detail herein.

For illustrative purposes, the following description of process 500 may refer to elements mentioned above in connection with FIGS. 1-4. In practical embodiments, portions of the process 500 may be performed by different elements of the antenna structures 100-400 such as: the conductive resonator 102, the feed lines 104, the shorting pin 140, and the faraday cage 106, etc. The process 500 may have functions, material, and structures that are similar to the embodiments shown in FIGS. 1-4. Therefore common features, functions, and elements may not be redundantly described here.

Process 500 may begin by providing a conductive resonator such as the conductive resonator 102 (task 502).

Process 500 may continue by providing a faraday cage such as the faraday cage 106 operable to shield the conductive resonator 102, the faraday cage 106 comprising an electromagnetically-shielding ground plane such as the electromagnetically-shielding ground plane 120 (task 504).

Process 500 may continue by providing a shorting pin such as the shorting pin 140 coupled to the conductive resonator 102 and the electromagnetically-shielding ground plane 120, and operable to electrically couple the conductive resonator 102 to the electromagnetically-shielding ground plane 120 (task 506).

Process 500 may continue by providing at least one feed line such as the feed lines 104 electromagnetically coupled to the conductive resonator 102 (task 508). As mentioned above, the feed lines 104 may be configured to drive the conductive resonator 102 and/or receive a signal from the conductive resonator 102, and may comprise, for example but without limitation, a single feed line, a plurality of feed lines, or any suitable configuration of feed lines, depending on antenna polarization requirements.

Process 500 may continue by forming a phased array antenna such as the phase array antenna 700 comprising an antenna structure such as the antenna structure 100/300/400 formed by at least one of the tasks 502-508 of the process 500 as an element of the lattice 702 (task 510).

Figure 6:
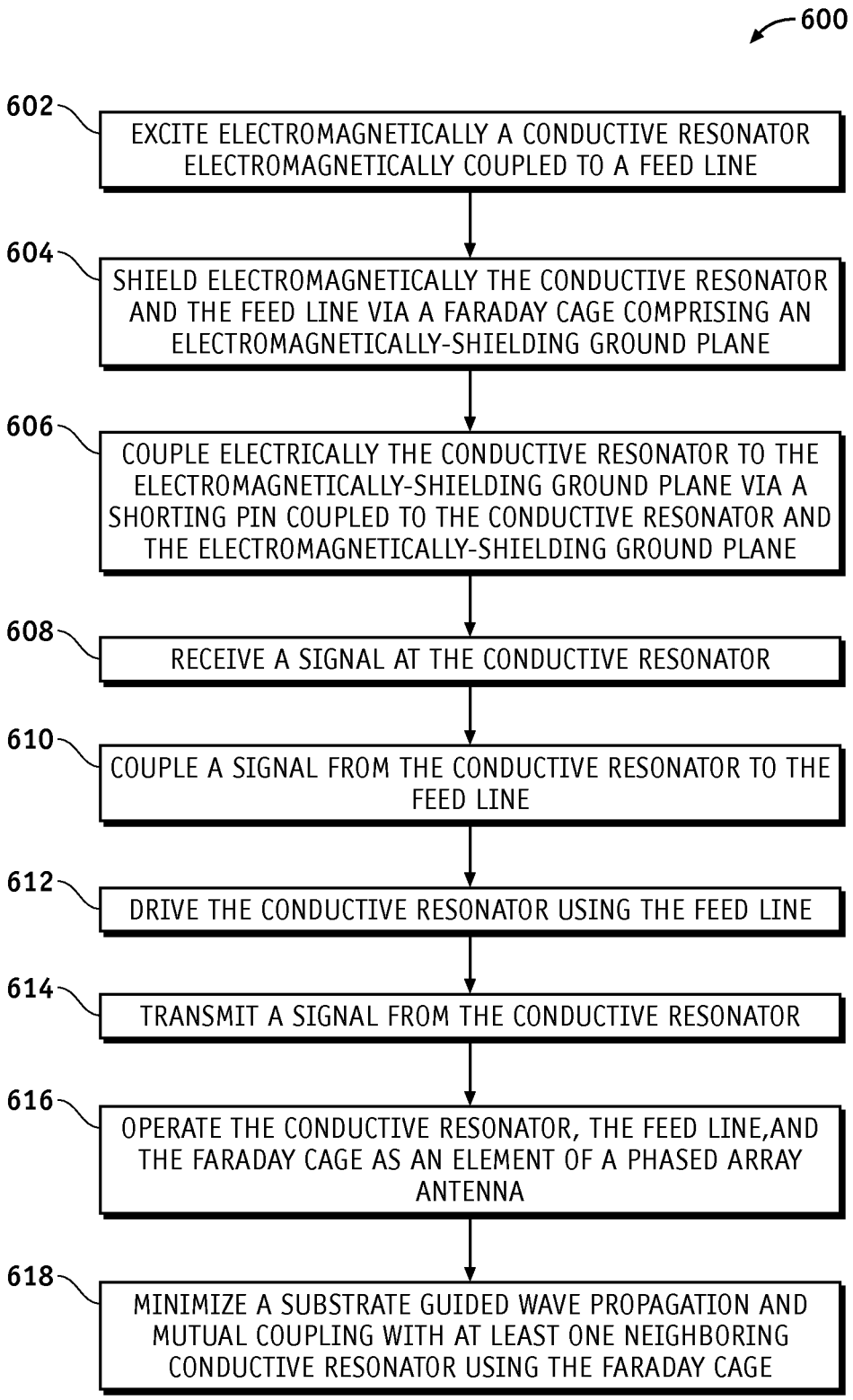
FIG. 6 is an illustration of an exemplary flowchart showing a process for communication using an antenna structure according to an embodiment of the disclosure.

FIG. 6 is an illustration of an exemplary flowchart showing a process 600 for communication using the phase array antenna 700 comprising the antenna structure 100/300/400 according to an embodiment of the disclosure. The various tasks performed in connection with process 600 may be performed mechanically, by software, hardware, firmware, or any combination thereof. It should be appreciated that process 600 may include any number of additional or alternative tasks, the tasks shown in FIG. 6 need not be performed in the illustrated order, and the process 600 may be incorporated into a more comprehensive procedure or process having additional functionality not described in detail herein.

For illustrative purposes, the following description of process 600 may refer to elements mentioned above in connection with FIGS. 1-4. In practical embodiments, portions of the process 600 may be performed by different elements of the structures 100-400 such as: the conductive resonator 102, the feed lines 104, the shorting pin 140, the faraday cage 106, etc. The process 600 may have functions, material, and structures that are similar to the embodiments shown in FIGS. 1-4. Therefore common features, functions, and elements may not be redundantly described here.

Process 600 may begin by exciting electromagnetically a conductive resonator such as the conductive resonator 102 that is electromagnetically coupled to a feed line such as the feed line 104 (task 602).

Process 600 may continue by shielding electromagnetically the conductive resonator 102 and the feed line 104 via a faraday cage such as the faraday cage 106 comprising an electromagnetically-shielding ground plane such as the electromagnetically-shielding ground plane 120 (task 604).

Process 600 may continue by coupling electrically the conductive resonator 102 to the electromagnetically-shielding ground plane 120 via a shorting pin such as the shorting pin 140 coupled to the conductive resonator 102 and the electromagnetically-shielding ground plane 120 (task 606).

Process 600 may continue by receiving a signal at the conductive resonator 102 (task 608).

Process 600 may continue by coupling a signal from the conductive resonator 102 to the feed line 104 (task 610).

Process 600 may continue by driving conductive resonator 102 using the feed line 104 (task 612).

Process 600 may continue by transmitting a signal from the conductive resonator 102 (task 614).

Process 600 may continue by operating the conductive resonator 102, the feed line 104, and the faraday cage 106 as an element of the phased array antenna 700 (FIG. 7) (task 616).

Process 600 may continue by minimizing a substrate guided wave propagation and mutual coupling with at least one neighboring conductive resonator using the faraday cage 106 (task 618). The combination of design features mentioned above and the faraday cage 106 (FIG. 1) minimize a substrate/ground plane guided wave propagation (e.g., through shielding of the electromagnetically-shielding ground plane 120). The combination of design features mentioned above and the faraday cage 106 also minimize a mutual coupling between neighboring conductive resonators (e.g., conductive resonator 102) of adjacent antenna elements such as adjacent antenna structures 100-400.

Minimizing the substrate/ground plane guided wave propagation and the mutual coupling between neighboring conductive resonators (e.g., conductive resonator 102) of adjacent antenna elements allows the phase array antenna 700 (FIG. 7) to scan down near the horizon. Scanning down near the horizon can provide functionality suitable for a phased array for SATCOM or other application requiring wide scan volume. The neighboring conductive resonator may comprise the conductive resonator 102 of the adjacent antenna structures 100/200/300/400 of the phase array antenna 700.

FIG. 7 is an illustration of an exemplary fabricated phased array antenna 700 (structure 700) according to an embodiment of the disclosure. The structure 700 has functions, material, and structures that are similar to the antenna structure 100/300. Therefore, common features, functions, and elements may not be redundantly described here.

The structure 700 comprises multiple tuned elements, multi-layered circuit boards and relevant design features as explained above in the context of discussion of FIGS. 1-4. The structure 700 comprises a plurality of antenna structures 704 (antenna structure 100/300 in FIGS. 1 and 3) as an element of the lattice 702 forming the fabricated phased array antenna 700. The antenna structures 704 provide an antenna array that allows for a single conformal aperture providing, for example but without limitation, a dual-band transmit and/or receive SATCOM aperture covering, both military bands of about 30-31 GHz, and about 43.5-45.5 GHz with the ability to extend frequency coverage down to include adjacent commercial SATCOM Ka-bands at about 27.5-30 GHz, or other transmit or receive structure.

In other embodiments, the antenna structures 704 provide an antenna array that allows for a single conformal aperture providing multi-band transmit and/or receive SATCOM aperture covering more than two frequency bands. In further embodiments, the antenna structures 704 provide an antenna array that allows for a single conformal aperture providing single-band transmit and/or receive SATCOM aperture covering a single frequency band.

In this manner, the fabricated phased array antenna 700 provides a wide scan volume, for example but without limitation, better than 60 degrees of conical scan volume from boresight, or other suitable scan volume, and maintains substantially good circular polarization axial ratio over specified frequency bands.

In this way, embodiments of the disclosure provide antenna systems and methods that minimize size, weight, and power (SWAP), as well as minimizing integration cost. As mentioned above, the SWAP is greatly reduced by elimination of "stovepiped" SATCOM banded systems and associated separate antenna installations. Embodiments provide a phased array antenna that can cover at least one SATCOM transmit and/or receive military EHF band, while being thin and lightweight. Embodiments can be scaled to other frequency bands and phased array antenna applications such as, for example but without limitation, Line-of-Sight communication links, SIGINT arrays, radars, sensor arrays, and the like. Embodiments of the disclosure provide a conformal antenna operable to greatly reduce aerodynamic drag and integration/maintenance cost.

The above description refers to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although FIGS. 1-7 depict example arrangements of elements, additional intervening elements, devices, features, or components may be present in an embodiment of the disclosure.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. The term "about" when referring to a numerical value or range is intended to encompass values resulting from experimental error that can occur when taking measurements.

Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

As used herein, unless expressly stated otherwise, "operable" means able to be used, fit or ready for use or service, usable for a specific purpose, and capable of performing a recited or desired function described herein. In relation to systems and devices, the term "operable" means the system and/or the device is fully functional and calibrated, comprises elements for, and meets applicable operability requirements to perform a recited function when activated. In relation to systems and circuits, the term "operable" means the system and/or the circuit is fully functional and calibrated, comprises logic for, and meets applicable operability requirements to perform a recited function when activated.

The invention claimed is:

1. An antenna structure comprising:

a conductive resonator configured on one layer and comprising a ring resonator, a spoked resonator comprising linked rings configured within the ring resonator, an outer slot resonator between the ring resonator and the spoked resonator, and an inner slot resonator between the linked rings;

a feed line electromagnetically coupled to the conductive resonator and configured to operate the conductive resonator in at least two frequency bands;

a faraday cage operable to shield the conductive resonator and the feedline, the faraday cage comprising an electromagnetically-shielding ground plane; and a shorting pin coupled to the conductive resonator and the electromagnetically-shielding ground plane, and operable to electrically couple the conductive resonator to the electromagnetically-shielding ground plane.

2. The antenna structure according to claim 1, wherein the feed line is operable to drive the conductive resonator.

3. The antenna structure according to claim 1, wherein the feed line is operable to receive a signal from the conductive resonator.

4. The antenna structure according to claim 1, wherein the feed line is electromagnetically coupled to the conductive resonator via an electromagnetic coupling comprising at least one member selected from the group consisting of: capacitive coupling, and inductive coupling.

5. The antenna structure according to claim 1, wherein the conductive resonator comprises an inner disk and an outer linked ring, and a tuning slot between the inner disk and the outer linked ring, wherein the inner disk and an outer linked ring are operable to create a tuning structure for the tuning slot.

6. The antenna structure according to claim 1, wherein the conductive resonator comprises at least one member selected from the group consisting of: at least one spoke structure, at least one ring structure, and a plurality of resonators.

7. The antenna structure according to claim 1, wherein the antenna structure forms a phased array antenna.

8. A method for communication using an antenna structure, the method comprising:

exciting electromagnetically a conductive resonator electromagnetically coupled to a feed line electromagnetically coupled to the conductive resonator and configured to operate the conductive resonator in at least two frequency bands, the conductive resonator configured on one layer and comprising a ring resonator, a spoked resonator comprising linked rings configured within the ring resonator, an outer slot resonator between the ring resonator and the spoked resonator, and an inner slot resonator between the linked rings;

shielding electromagnetically the conductive resonator and the feed line via a faraday cage comprising an electromagnetically-shielding ground plane; and coupling electrically the conductive resonator to the electromagnetically-shielding ground plane via a shorting pin coupled to the conductive resonator and the electromagnetically-shielding ground plane.

9. The antenna structure according to claim 1, wherein the faraday cage further comprises at least one offset via, and a notch offset from the feed line.

10. The antenna structure according to claim 1, wherein the antenna structure is operable to communicate within at least one member selected from the group consisting of: about 27.5-30 GHz for commercial bands, about 30-31 GHz and about 43.5-45.5 GHz for military bands, and signals in adjacent Ka-bands.

11. A method for forming an antenna structure, the method comprising:

providing a conductive resonator configured on one layer and comprising a ring resonator, a spoked resonator comprising linked rings configured within the ring resonator, an outer slot resonator between the ring resonator and the spoked resonator, and an inner slot resonator between the linked rings;

providing at least one feed line electromagnetically coupled to the conductive resonator and configured to operate the conductive resonator in at least two frequency bands;

providing a faraday cage operable to shield the conductive resonator and the feedline, the faraday cage comprising an electromagnetically-shielding ground plane; and providing a shorting pin coupled to the conductive resonator and the electromagnetically-shielding ground plane, and operable to electrically couple the conductive resonator to the electromagnetically-shielding ground plane.

12. The method according to claim 11, wherein the resonator comprises at least one member selected from the group consisting of: at least one spoke structure, at least one ring structure, and a plurality of resonators.

13. The method according to claim 11, further comprising forming a phased array antenna comprising the antenna structure as an element of a lattice.

14. The method according to claim 8, further comprising minimizing a substrate guided wave propagation and mutual coupling with at least one neighboring conductive resonator using the faraday cage.

15. The method according to claim 8, further comprising receiving a signal at the conductive resonator.

16. The method according to claim 8, further comprising coupling a signal from the conductive resonator to the feed line.

17. The method according to claim 8, further comprising driving the conductive resonator using the feed line.

18. The method according to claim 8, further comprising transmitting a signal from the conductive resonator.

19. The method according to claim 8, further comprising operating the conductive resonator, the feed line, and the faraday cage as an element of a phased array antenna.

20. The method according to claim 8, wherein the conductive resonator comprises at least one member selected from the group consisting of: at least one spoke structure, at least one ring structure, and a plurality of resonators.

* * * * *